US008807384B2

(12) United States Patent
Cheek

(10) Patent No.: US 8,807,384 B2
(45) Date of Patent: Aug. 19, 2014

(54) CONTAINER WITH TRAPEZOID-SHAPED LONGITUDINAL SIDE AND RELATED METHODS

(71) Applicant: Alan Cheek, Mount Dora, FL (US)

(72) Inventor: Alan Cheek, Mount Dora, FL (US)

( * ) Notice: Subject to any disclaimer, the term of this patent is extended or adjusted under 35 U.S.C. 154(b) by 0 days.

(21) Appl. No.: 13/622,620

(22) Filed: Sep. 19, 2012

(65) Prior Publication Data

US 2014/0076893 A1 Mar. 20, 2014

(51) Int. Cl.
*B65D 8/18* (2006.01)

(52) U.S. Cl.
USPC ..... 220/660; 141/109

(58) Field of Classification Search
USPC ..... 220/660, 695, 696; 15/257.1–257.9; D32/74; 141/108, 109; 37/903, 444; 294/176, 177, 178, 179, 180
See application file for complete search history.

(56) References Cited

U.S. PATENT DOCUMENTS

| | | | | |
|---|---|---|---|---|
| 341,175 | A | 5/1886 | Shaw | |
| 961,531 | A | 6/1910 | Reeves | |
| D190,532 | S | 6/1961 | Heimsoth | |
| 2,988,767 | A | 6/1961 | Tretwold et al. | |
| 3,170,183 | A | 2/1965 | Leatherman | |
| D353,241 | S | 12/1994 | Breen | |
| D376,235 | S | 12/1996 | Presnell | |
| 6,199,718 | B1 | 3/2001 | Ellis | |
| 6,233,781 | B1 * | 5/2001 | Savage | 15/257.4 |
| 6,698,058 | B2 | 3/2004 | Cann | |
| D537,597 | S | 2/2007 | Bolden | |
| D544,669 | S | 6/2007 | Casteel et al. | |
| D546,514 | S | 7/2007 | Byrne | |
| 7,469,798 | B1 | 12/2008 | Miller | |
| D625,068 | S | 10/2010 | Shannon | |
| 2001/0045371 | A1 * | 11/2001 | Ordonez | 206/499 |
| 2004/0173622 | A1 | 9/2004 | Findleton | |
| 2008/0289663 | A1 | 11/2008 | Young | |

OTHER PUBLICATIONS

Sky Marketplace, "Plastic Injection Molding," 1 page, 2012.

* cited by examiner

*Primary Examiner* — Anthony Stashick
*Assistant Examiner* — James Way
(74) *Attorney, Agent, or Firm* — Allen, Dyer, Doppelt, Milbrath & Gilchrist, P.A.

(57) ABSTRACT

A container may include a body portion having opposing open and closed ends, and a trapezoid-shaped longitudinal side extending laterally between the open and closed ends. The open end may include a latch portion extending laterally and being opposite to the trapezoid-shaped longitudinal side. The container may also include a handle coupled to the open end, and switchingly coupled to the latch portion.

21 Claims, 7 Drawing Sheets

CONTAINER WITH TRAPEZOID-SHAPED LONGITUDINAL SIDE AND RELATED METHODS

FIELD OF THE INVENTION

The present invention relates to the field of containers, and, more particularly, to a container and related methods.

BACKGROUND OF THE INVENTION

The bucket is one of the most common and widely used containers. The typical bucket comprises a substantially cylindrical body with open and closed ends. The bucket includes a handle, for example, a metallic wire handle, coupled to opposing sides of the open end.

In common applications, the bucket may be used in combination with separate dustpan and broom. In typical fashion, the broom and the dustpan are used to collect material, such as refuse, into the bucket. In applications where the material is liquid, the user may utilize the bucket as a bail, i.e. grabbing the bucket and using it solely to scoop up the material. The typical bucket may also be used to gather a plurality of small items at the same time, such as grain, feed pellets, etc. A drawback to using the typical bucket for bailing applications may be that the cylindrical shape of the bucket is not conducive to scooping liquids efficiently. Indeed, in bailing applications, such as when the user needs to bail liquids (e.g. water, mud, debris, and an array of numerous items) out of an enclosed area, the curved nature of the bucket sides may render the device ineffective.

SUMMARY OF THE INVENTION

In view of the foregoing background, it is therefore an object of the present invention to provide a container that is more readily used for bailing, scooping, gathering, and transporting items.

This and other objects, features, and advantages in accordance with the present invention are provided by a container that may comprise a body portion having opposing open and closed ends, and a trapezoid-shaped longitudinal side extending laterally between the open and closed ends. The open end may include a latch portion extending laterally therefrom and being opposite to the trapezoid-shaped longitudinal side. The container may also include a handle coupled to the open end, and switchingly coupled to the latch portion. Advantageously, the trapezoid-shaped longitudinal side may be used to scoop up material (e.g. solid or liquid).

In some embodiments, the closed end may comprise a first handle recess longitudinally aligned with the latch portion and for gripping by a user. Also, the latch portion may comprise a second handle recess for gripping by the user.

Additionally, the trapezoid-shaped longitudinal side may extend laterally adjacent the open end a first distance and extend laterally adjacent the closed end a second distance less than the first distance. The body portion may have a diameter, and the trapezoid-shaped longitudinal side may have a width greater than the diameter adjacent the open end.

Moreover, the trapezoid-shaped longitudinal side may include a flat outer surface. The trapezoid-shaped longitudinal side may also include an inner surface having a medial bump. The container may further comprise a lid portion to be coupled to the open end, and the lid portion may comprise opposing laterally extending sides for respectively coupling to the latch portion and to the trapezoid-shaped longitudinal side. Also, the open end may comprise a flanged rim. Advantageously, in this embodiment, the container may serve as a seat.

Another aspect is directed to a method for a method of making a container. The method may include forming a body portion having opposing open and closed ends, and a trapezoid-shaped longitudinal side extending laterally between the open and closed ends. The open end may comprise a latch portion extending laterally therefrom and being opposite to the trapezoid-shaped longitudinal side. The method may also include coupling a handle to the open end, and to be switchingly coupled to the latch portion.

DETAILED DESCRIPTION OF THE PREFERRED EMBODIMENTS

Figure 1:
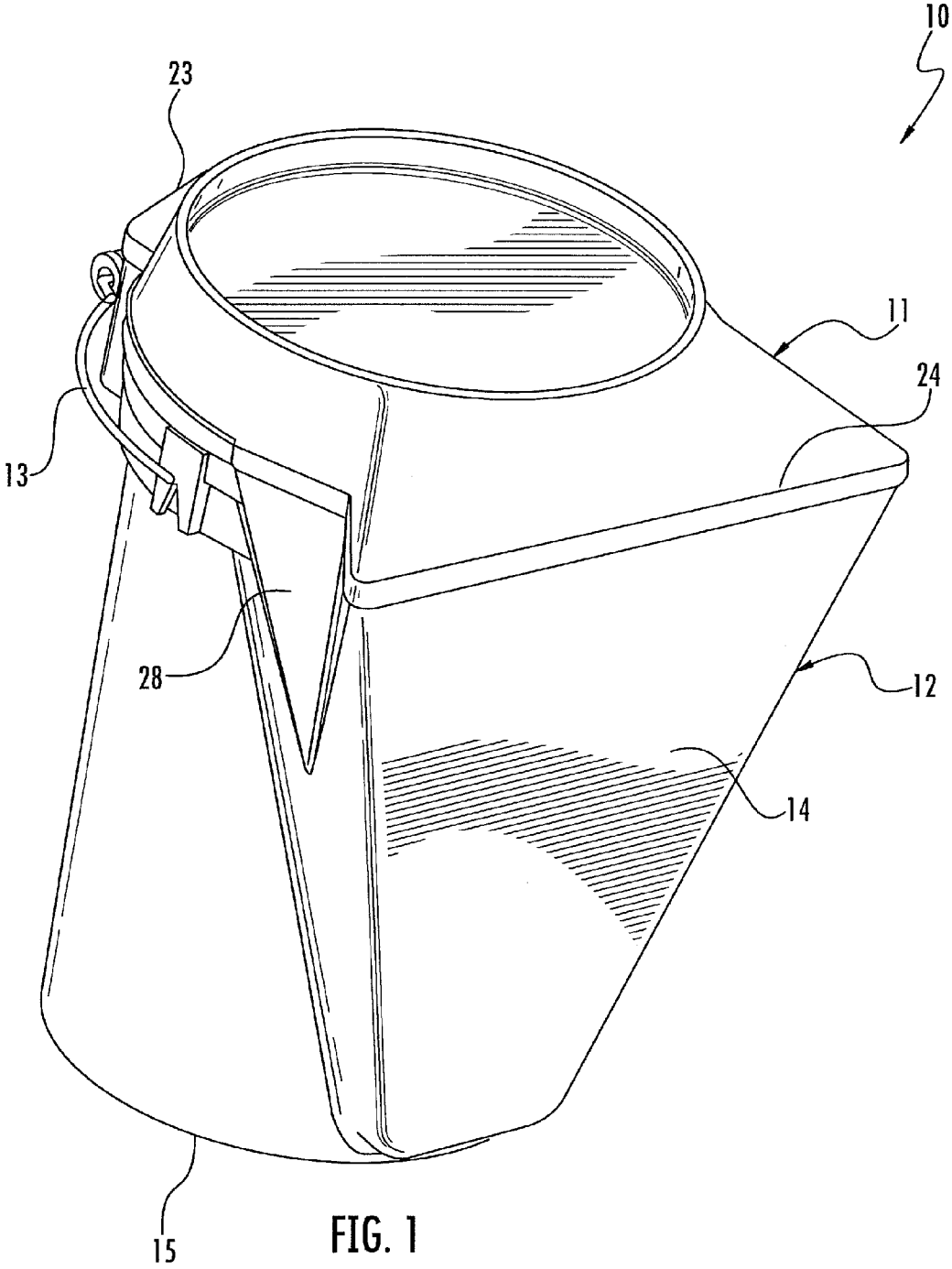
FIG. 1 is a perspective view of a container, according to the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Referring now to FIGS. 1-5, a container 10 according to the present invention is now described. In the illustrated embodiment, the container 10 comprises a bail bucket, but in other embodiments, the container may comprise other containers with varying shapes. The container 10 illustratively includes a body portion 12 having opposing open and closed ends 15-16, and a trapezoid-shaped longitudinal side 14 extending laterally between the open and closed ends. The open end 16 illustratively includes a latch portion 17 extending laterally therefrom and being opposite to the trapezoid-shaped longitudinal side 14. In some embodiments, the open end 16 may comprise a flanged rim 32. As will be appreciated by those skilled in the art, the flanged rim 32 provides structural strength. The container 10 illustratively includes a handle 13 coupled to opposing sides of the open end 16, and switchingly coupled (latched) to the latch portion 17. For example, the handle 13 may be coupled to the latch portion 17 using a protruding notch 34 (FIG. 3) or a spring loaded locking mechanism. For example, the handle 13 may comprise a metal wire or a plastic.

The container 10 illustratively includes a lid portion 11 to be coupled to the open end 16. The lid portion 11 comprises opposing laterally extending sides 23-24 for respectively coupling to the latch portion 17 and to the trapezoid-shaped longitudinal side 14. As perhaps best seen in FIG. 4, the lid portion 11 illustratively includes a circular recess 31. Helpfully, the circular recess 31 may aid in the user using the container 10 as a makeshift seating device, i.e. providing a padding of sorts for the user. In some embodiments, the lid portion 11 may comprise a cushion (not shown) filling the circular recess 31 to provide more comfort for the user. The cushion may be attached to the circular recess 31 using an adhesive.

Figure 2:
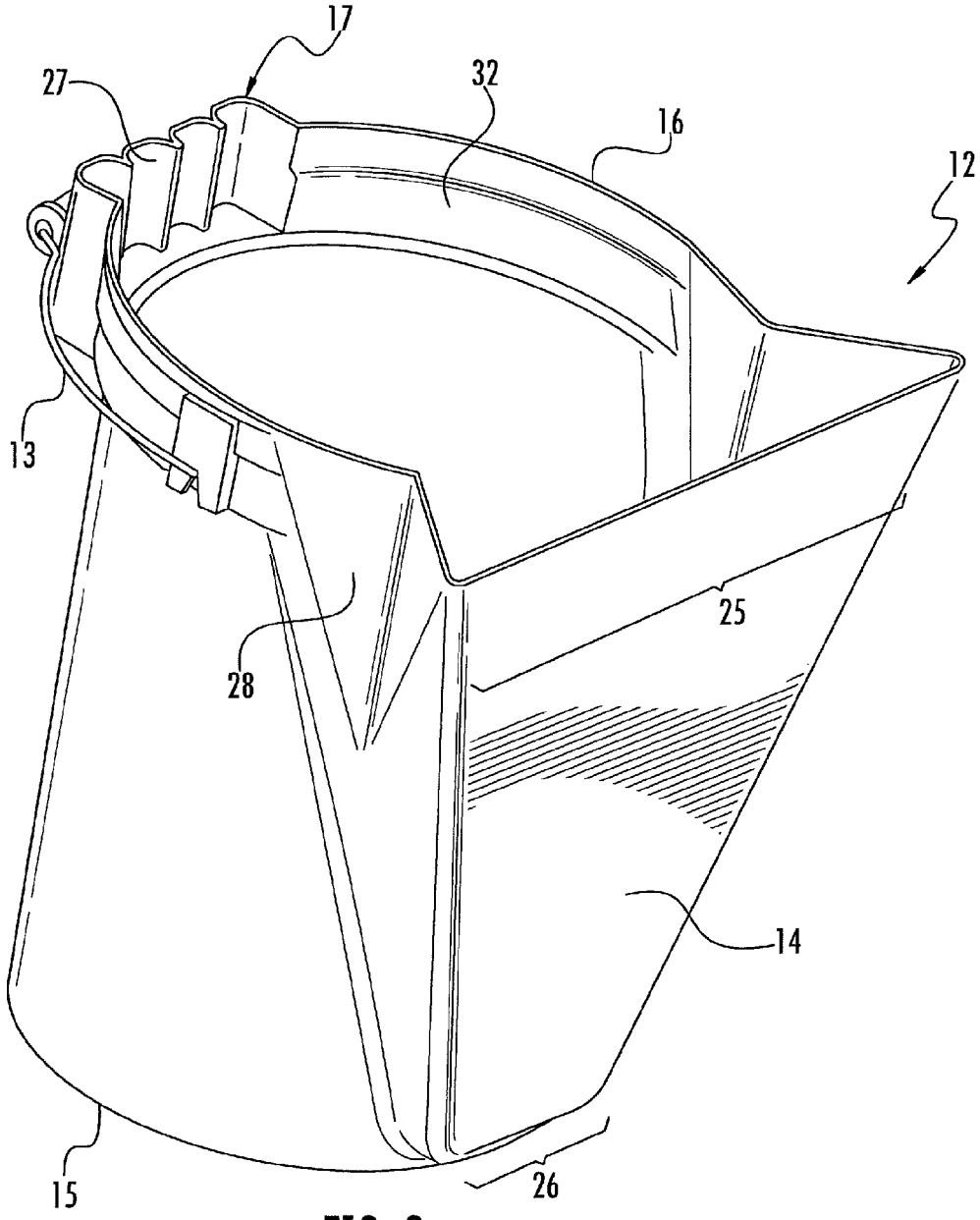
FIG. 2 is the perspective view of the container of FIG. 1 with the lid portion removed.
Figure 3:
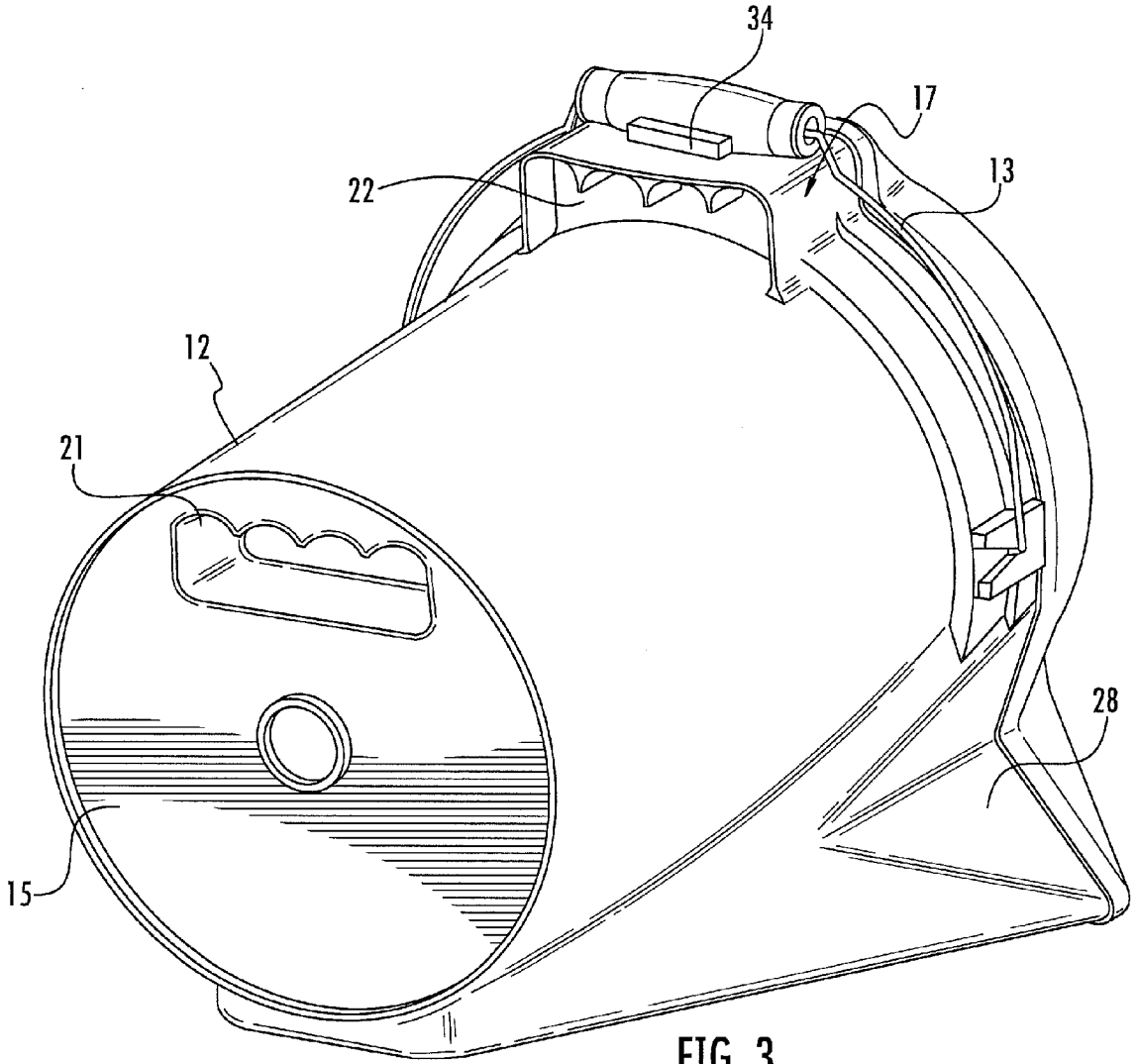
FIG. 3 is another perspective view of the container of FIG. 1.
Figure 4:
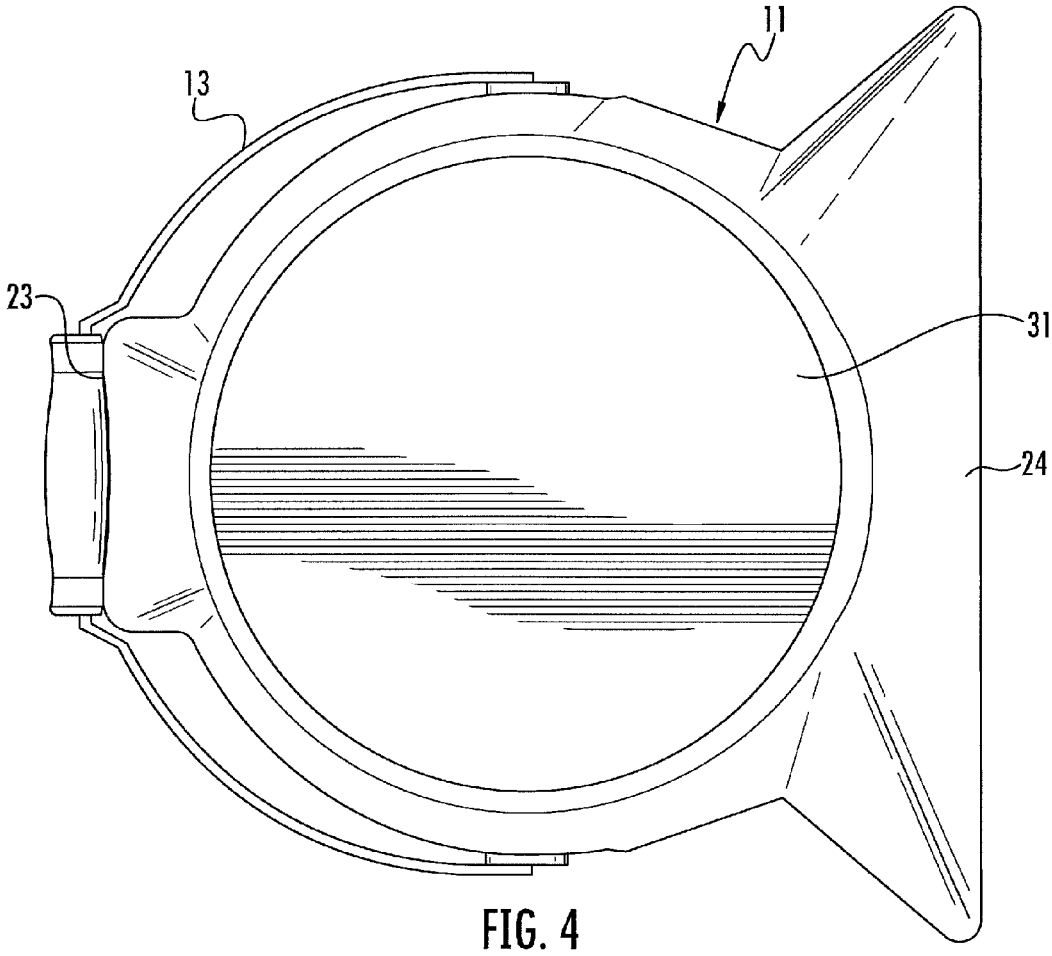
FIG. 4 is a top plan view of the container of FIG. 1.
Figure 5:
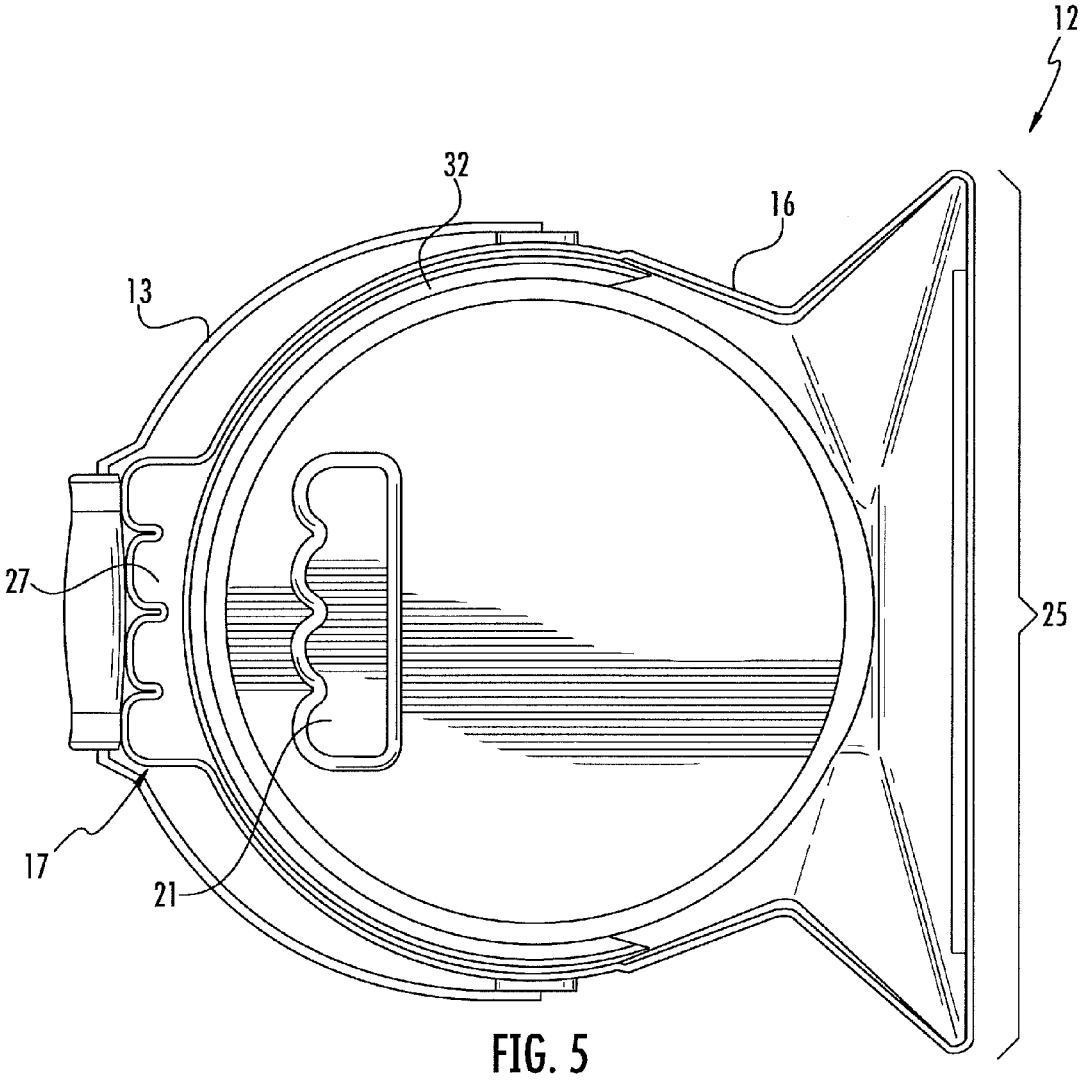
FIG. 5 is a top plan view of the container of FIG. 1 with the lid portion removed.

In the illustrated embodiment, the closed end 15 includes a first handle recess 21 longitudinally aligned with the latch portion 17 and for gripping by a user. Also, the latch portion 17 comprises a second handle recess 22 for gripping by the user, for example, for transporting the bucket 10 without using the handle 13. As shown in FIGS. 2 and 5, the latch portion 17 includes a third handle recess 27 opposing the second handle recess 22. Advantageously, this may permit the user to have a flexible grip during difficult bailing or gathering applications. Each of the handle recesses 21-22, 27 illustratively includes a plurality of curved recesses. In the illustrated embodiment, each curved recess is oversized and may also include a textured surface (not shown), thereby providing comfort and a sure grip for the user. The plurality of curved recesses may better fit the fingers of the user with gloves on, thereby providing a more secure grip.

Additionally, the trapezoid-shaped longitudinal side 14 extends laterally adjacent the open end 16 a first distance 25 and extend laterally adjacent the closed end 15 a second distance 26 less than the first distance, i.e. the trapezoid-shaped longitudinal side projects outward from the body portion 12. The body portion 12 has a diameter, and the trapezoid-shaped longitudinal side 14 has a width greater than the diameter adjacent the open end 16. Moreover, the trapezoid-shaped longitudinal side 14 includes a flat outer surface. As perhaps best seen in FIGS. 1-3, the trapezoid-shaped longitudinal side 14 illustratively includes a pair of recessed triangle-shaped portions 28, which provide structural strength and allow the bucket 10 to remain stationary without assistance of the user.

Another aspect is directed to a method for a method of making a container 10. The method may include forming a body portion 12 having opposing open and closed ends 15-16, and a trapezoid-shaped longitudinal side 14 extending laterally between the open and closed ends. The open end 16 may comprise a latch portion 17 extending laterally therefrom and being opposite to the trapezoid-shaped longitudinal side 14. The method may also include coupling a handle 13 to opposing sides of the open end 16, and to be switchingly latched to the latch portion 17.

Figure 6:
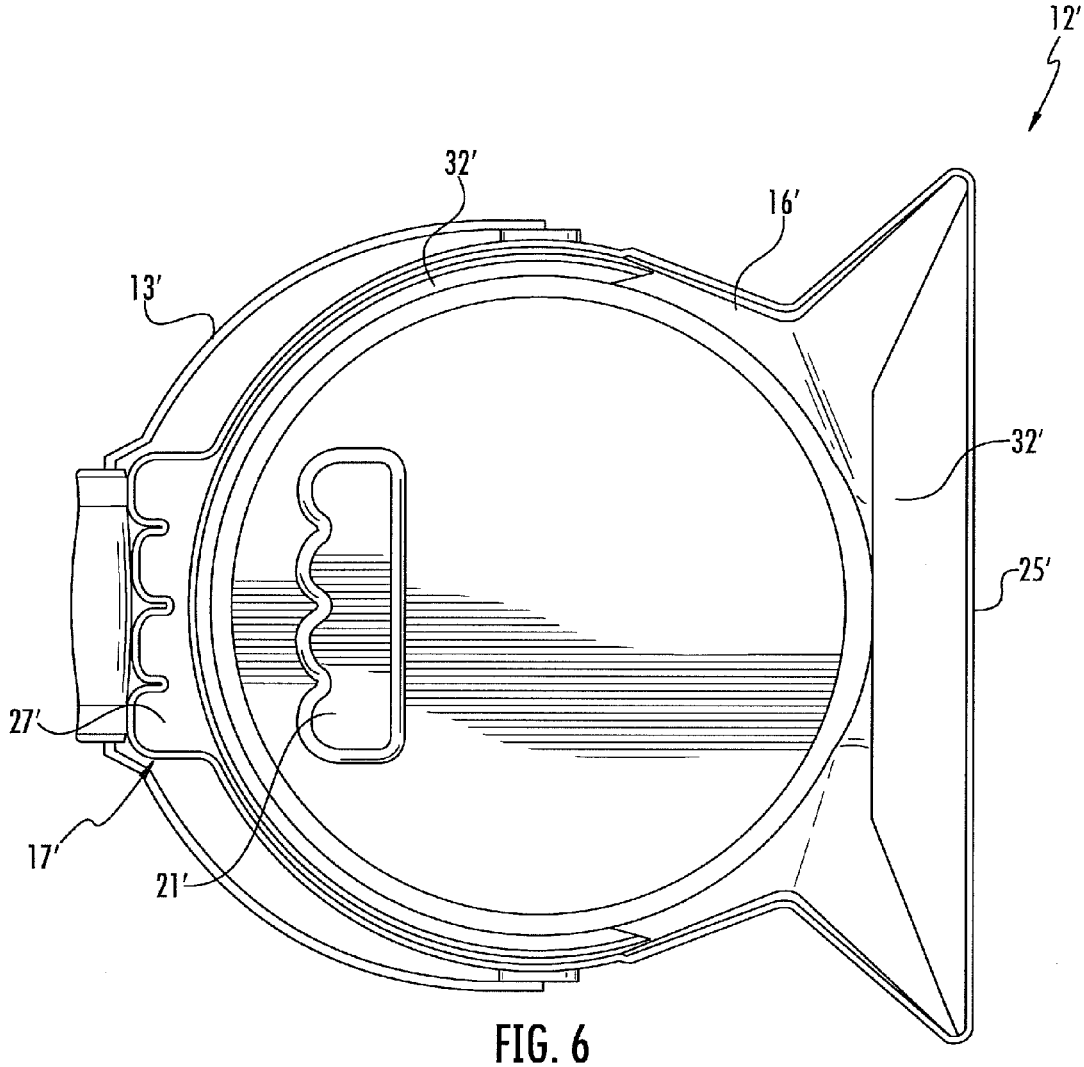
FIG. 6 is a top plan view of another embodiment of the container of FIG. 1 with the lid portion removed.

Referring now additionally to FIG. 6, another embodiment of the container 10' is now described. In this embodiment of the container 10', those elements already discussed above with respect to FIGS. 1-5 are given prime notation and most require no further discussion herein. This embodiment differs from the previous embodiment in that this container 10' includes the trapezoid-shaped longitudinal side 14' having an inner surface having a medial bump 32' with a gradual incline adjacent the open end 16 and a sharper incline adjacent the closed end 15. In some embodiments, the incline of the medial bump 32' adjacent the closed end 15 is 90 degrees, i.e. a straight drop. Also, the medial bump 32' may extend completely across the trapezoid-shaped longitudinal side 14, or may only extend partially, i.e. leaving a gap at the edges of the trapezoid-shaped longitudinal side 14, thereby aiding in an even and controlled pour when liquid contents are removed from the bucket 10. Advantageously, the medial bump 32' may prevent unwanted backwash during bailing applications.

Figure 7:
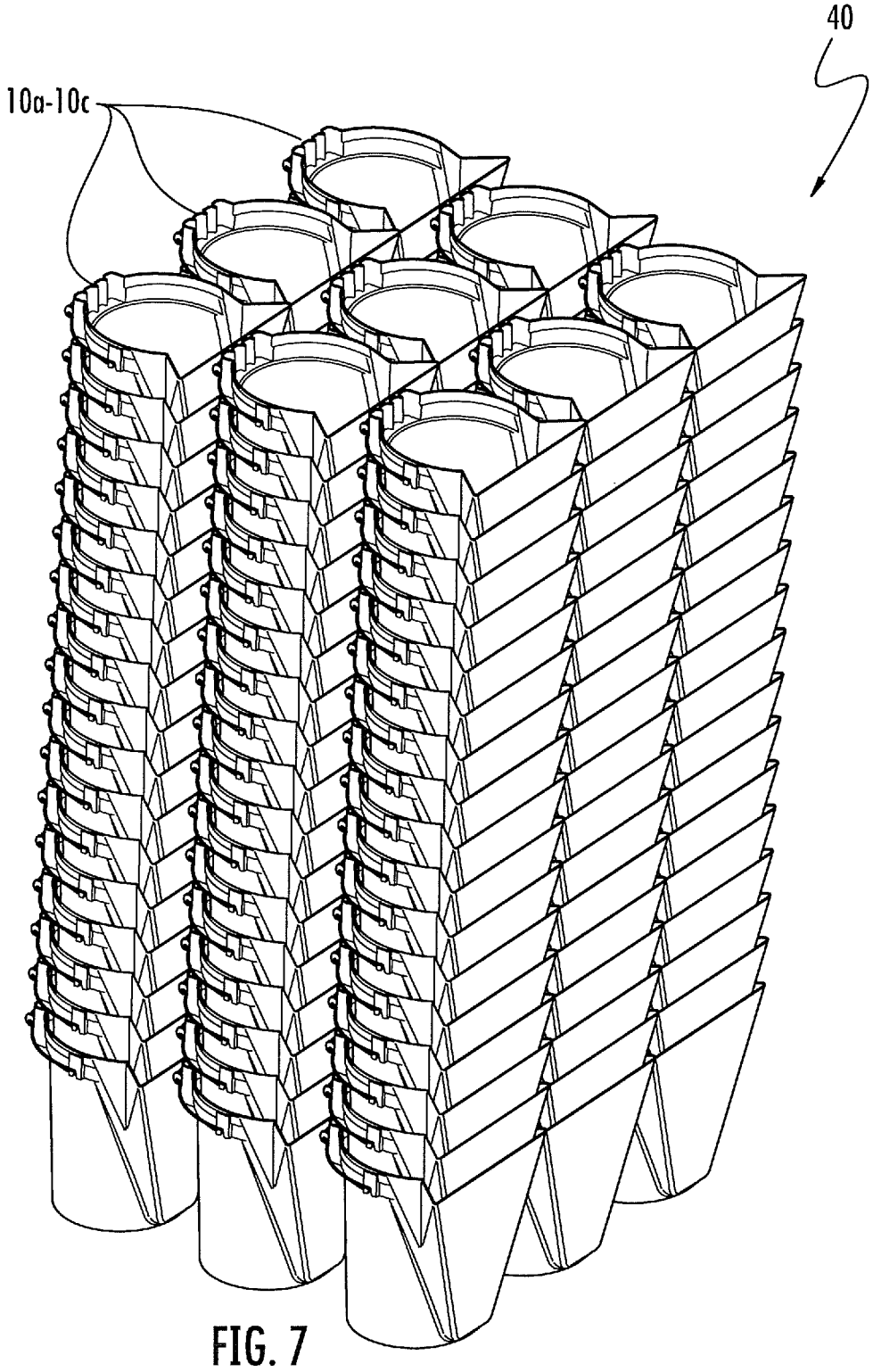
FIG. 7 is a pallet stack of the container of FIG. 1.

Referring now to FIG. 7, a pallet stack 40 of 144 containers 10*a*-10*c*. As shown, the advantageous shape of the above described container 10 permits for being readily stacked and shipped in large quantities. As will be appreciated by those skilled in the art, the ability to readily stack the container 10 may reduce cost of delivery and transportation, which may be helpful in retail sales.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A container comprising:

a body portion having a partially radially curved open end and an opposing closed end, and a trapezoid-shaped longitudinal side extending laterally between said open and closed ends, the trapezoid-shaped longitudinal side defining a scoop portion adjacent the partially radially curved open end, the scoop portion having opposing first and second acute angle-shaped ends, and a side defining a scoop edge and a scoop mouth having a width greater than a diameter of the said partially radially curved open end, the opposing first and second acute angle-shaped ends each defining an opposed recess adjacent an intersection of said partially radially curved open end and said scoop portion;

said partially radially curved open end comprising a handle portion extending laterally therefrom and being opposite to said trapezoid-shaped longitudinal side; and a handle coupled said partially radially curved open end.

2. The container of claim 1 wherein said closed end comprises a first handle recess longitudinally aligned with said handle portion and for gripping by a user.

3. The container of claim 2 wherein said handle portion comprises a second handle recess for gripping by the user.

4. The container of claim 1 wherein said trapezoid-shaped longitudinal side extends laterally adjacent said partially radially curved open end a first distance and extends laterally adjacent said closed end a second distance less than the first distance.

5. The container of claim 1 wherein said trapezoid-shaped longitudinal side includes a flat outer surface.

6. The container of claim 1 wherein said trapezoid-shaped longitudinal side includes an inner surface having a medial bump.

7. The container of claim 1 further comprising a lid portion to be coupled to said partially radially curved open end; and wherein said lid portion comprises opposing laterally extending sides for respectively coupling to said handle portion and to said trapezoid-shaped longitudinal side.

8. The container of claim 1 wherein said partially radially curved open end comprises a flanged rim.

9. A container comprising:

a body portion having a partially radially curved open end and an opposing closed end, and a trapezoid-shaped longitudinal side extending laterally between said open and closed ends, the trapezoid-shaped longitudinal side defining a scoop portion adjacent the partially radially curved open end, the scoop portion having opposing first and second acute angle-shaped ends, and a side defining a scoop edge and a scoop mouth having a width greater than a diameter of the said partially radially curved open end, the opposing first and second acute angle-shaped ends each defining an opposed recess adjacent an intersection of said partially radially curved open end and said scoop portion;

said partially radially curved open end comprising a handle portion extending laterally therefrom and being opposite to said trapezoid-shaped longitudinal side;

said closed end comprising a first handle recess longitudinally aligned with said handle portion, said handle portion comprising a second handle recess cooperating with said first handle recess for gripping by a user;

said trapezoid-shaped longitudinal side extending laterally adjacent said partially radially curved open end a first distance and extending laterally adjacent said closed end a second distance less than the first distance; and a handle coupled to said partially radially curved open end.

10. The container of claim 9 wherein said trapezoid-shaped longitudinal side includes a flat outer surface.

11. The container of claim 9 wherein said trapezoid-shaped longitudinal side includes an inner surface having a medial bump.

12. The container of claim 9 further comprising a lid portion to be coupled to said partially radially curved open end; and wherein said lid portion comprises opposing laterally extending sides for respectively coupling to said handle portion and to said trapezoid-shaped longitudinal side.

13. A method of making a container comprising:

forming a body portion having a partially radially curved open end and an opposing closed end, and a trapezoid-shaped longitudinal side extending laterally between the open and closed ends, the trapezoid-shaped longitudinal side defining a scoop portion adjacent the partially radially curved open end, the scoop portion having opposing first and second acute angle-shaped ends, and a side defining a scoop edge and a scoop mouth having a width greater than a diameter of the partially radially curved open end, the opposing first and second acute angle-shaped ends each defining an opposed recess adjacent an intersection of the partially radially curved open end and the scoop portion;

the partially radially curved open end comprising a handle portion extending laterally therefrom and being opposite to the trapezoid-shaped longitudinal side; and coupling a handle to the partially radially curved open end.

14. The method of claim 13 further comprising forming the closed end to comprise a first handle recess longitudinally aligned with the handle portion and for gripping by a user.

15. The method of claim 14 further comprising forming the handle portion to comprise a second handle recess for gripping by the user.

16. The method of claim 13 further comprising forming the trapezoid-shaped longitudinal side to extend laterally adjacent the partially radially curved open end a first distance and to extend laterally adjacent the closed end a second distance less than the first distance.

17. The method of claim 13 further comprising forming the trapezoid-shaped longitudinal side to include a flat outer surface.

18. The method of claim 13 further comprising coupling a lid portion to the partially radially curved open end; and wherein the lid portion comprises opposing laterally extending sides for respectively coupling to the handle portion and to the trapezoid-shaped longitudinal side.

19. The container of claim 3 wherein said second handle recess comprises a pair of opposing handle recesses.

20. The container of claim 9 wherein said second handle recess comprises a pair of opposing handle recesses.

21. The method of claim 13 wherein the second handle recess comprises a pair of opposing handle recesses.

* * * * *